US006027409A

United States Patent [19]

Favorito et al.

[11] Patent Number: 6,027,409

[45] Date of Patent: Feb. 22, 2000

[54] CHILDREN'S RECLINEABLE SWING SEAT

[75] Inventors: Julia Favorito, Buffalo; Gerald P. Sitarski, Grand Island, both of N.Y.

[73] Assignee: Mattel, Inc., El Segundo, Calif.

[21] Appl. No.: 09/309,883

[22] Filed: May 11, 1999

[51] Int. Cl.[7] ..... A63G 9/04

[52] U.S. Cl. ..... 472/118; 472/119

[58] Field of Search ..... 472/118–125; 297/273, 274, 277, 278; 5/102, 103, 105, 107, 108, 109

[56] References Cited

U.S. PATENT DOCUMENTS

| | | | |
|---|---|---|---|
| 4,805,902 | 2/1989 | Casagrande | 472/119 |
| 4,822,033 | 4/1989 | Kohus et al. | 472/119 |
| 4,940,229 | 7/1990 | Foster | 472/119 |
| 5,803,817 | 9/1998 | Stern | 472/118 |

*Primary Examiner*—Kien T. Nguyen
*Attorney, Agent, or Firm*—Morgan, Lewis & Bockius LLP

[57] ABSTRACT

A seat recline mechanism for an infant swing is shown that provides adjustment of the inclination of the seat with respect to a single swing arm. The seat recline mechanism includes a pivot pin that is mounted in the lower end of the swing arm. The seat is pivotally mounted on the swing arm by the pivot pin. The seat can be secured in the reclined or upright position by spring-biased locking pins or protrusions extending out from sides of the swing arm, with the locking pins snapping into apertures located in one of two or more angular positions on a U-shaped sleeve protruding from the seat back. The seat can be converted between an upright position and an inclined position by depressing the spring-biased locking pins or buttons in order to disengage the swing arm from one angular position relative to the seat, thus allowing the seat to rotate about its pivot axis relative to the swing arm until the spring-biased buttons snap into apertures corresponding to a different angular position.

18 Claims, 6 Drawing Sheets

CHILDREN'S RECLINEABLE SWING SEAT

BACKGROUND OF THE INVENTION

Background of the Invention

The present invention relates to infant seats that include an infant swing suspended by an arm. More particularly, it relates to the attachment mechanism for pivotally attaching the infant seat to the swing arm for movement of the seat relative to the arm between a more reclined orientation and a more upright orientation.

Infant swings are well known in the art. In conventional swings, a seat is suspended from a pair of arms that hang down from a crosspiece, with the arms being connected to either side of the seat. The existing arrangements for infant swings often make it awkward to put the child into, or take the child out of the swing because the crosspiece extends across the swing over the seat. The crosspiece blocks easy access to the seat, causing a parent to bend and stretch to put a child into the seat.

Some conventional infant swings have improved accessibility of the seat by the elimination of the crosspiece. One approach to eliminating the crosspiece is to provide a pair of inverted U-shaped leg assemblies that are tilted toward each other and joined at the upper ends. Again, the seat is suspended by a pair of arms, with each arm being suspended from one of the joints at the upper ends of the U-shaped leg assemblies. The two top joints define a fixed horizontal axis of rotation about which the seat swings. Although this conventional frame permits ready access to the seat from front and top, it inhibits access from the sides of the swing.

Another alternative approach is to form the frame for the infant swing from two C-shaped legs, angled together and joined at the tops of the legs. A single swing arm swings about a horizontal axis through the joint. This permits ready access from front and sides. However, it is relatively more difficult to couple the seat to a single swing arm than to two opposed swing arms.

U.S. Pat. No. 5,803,817, the disclosure of which is hereby incorporated herein by reference, discloses an infant swing that includes a plurality of legs and a swing arm mounted to the legs for swinging about a horizontal swing axis (as shown in FIG. 1A). The infant seat is mounted to the lower end of the swing arm by a seat-to-swing coupler that includes a T-shaped connector with laterally extending posts that are received in a T-shaped receiving cavity of a pivot plate, with slots in the side wall of the cavity that slidingly receive the connector posts. The pivot plate is pivotably mounted to the seat to permit the seat to be disposed in an upright orientation and a reclined orientation.

In all of the above mentioned conventional infant swings, the complexity of the attachment between the swing arm and the seat makes it difficult for a user to assemble the infant swing as well as increasing the costs associated with manufacturing of the infant swing.

SUMMARY OF THE INVENTION

In view of the foregoing disadvantages of prior art infant swings, the invention provides a seat for a child's swing that includes a shell having a seating surface and a rear surface opposite the seating surface. A swing arm is pivotally connected at a distal end of the swing arm to the rear surface of the shell for pivotal movement of the seat about a transverse axis that is substantially perpendicular to a longitudinal axis of the swing arm. The seat shell and swing arm can be selectively engaged with each other in at least two relative orientations about the transverse axis. In a preferred embodiment the selective engagement is accomplished by including on the rear surface of the seat a first projecting portion toward a first longitudinal end of the seat in the form of a U-shaped sleeve that has two angularly spaced stops engageable with the swing arm for selective positioning of the seat relative to the swing arm as the seat is pivoted about the transverse axis. The rear surface of the seat further includes additional projecting portions in the form of two spaced bosses located toward the second longitudinal end of the seat between which a pivot pin oriented along the transverse axis is press fit, with the pivot pin also passing through the distal end of the swing arm.

The infant swing according to the invention is secured in a more upright position or a more reclined position by spring-biased protrusions or locking pins extending out from sides of the swing arm, with the spring-biased protrusions snapping into one of two different apertures that form the angularly spaced stops located in the U-shaped sleeve on the rear surface of the seat shell. The U-shaped sleeve on the rear of the seat defines an opening through which the swing arm is inserted before the swing arm is pivotally connected at its distal end by the pivot pin between the spaced bosses toward the second end of the seat.

Two substantially parallel longitudinal ribs extend at approximately right angles to the rear surface of the seat shell and define a channel extending between the U-shaped sleeve and the spaced bosses. The swing arm fits within the channel when at least one of the two angularly spaced stops is engaged with the swing arm, and the distal end of the swing arm is pivotally mounted by the pivot pin between the spaced bosses.

DETAILED DESCRIPTION OF THE PREFERRED EMBODIMENTS

Figure 1A:
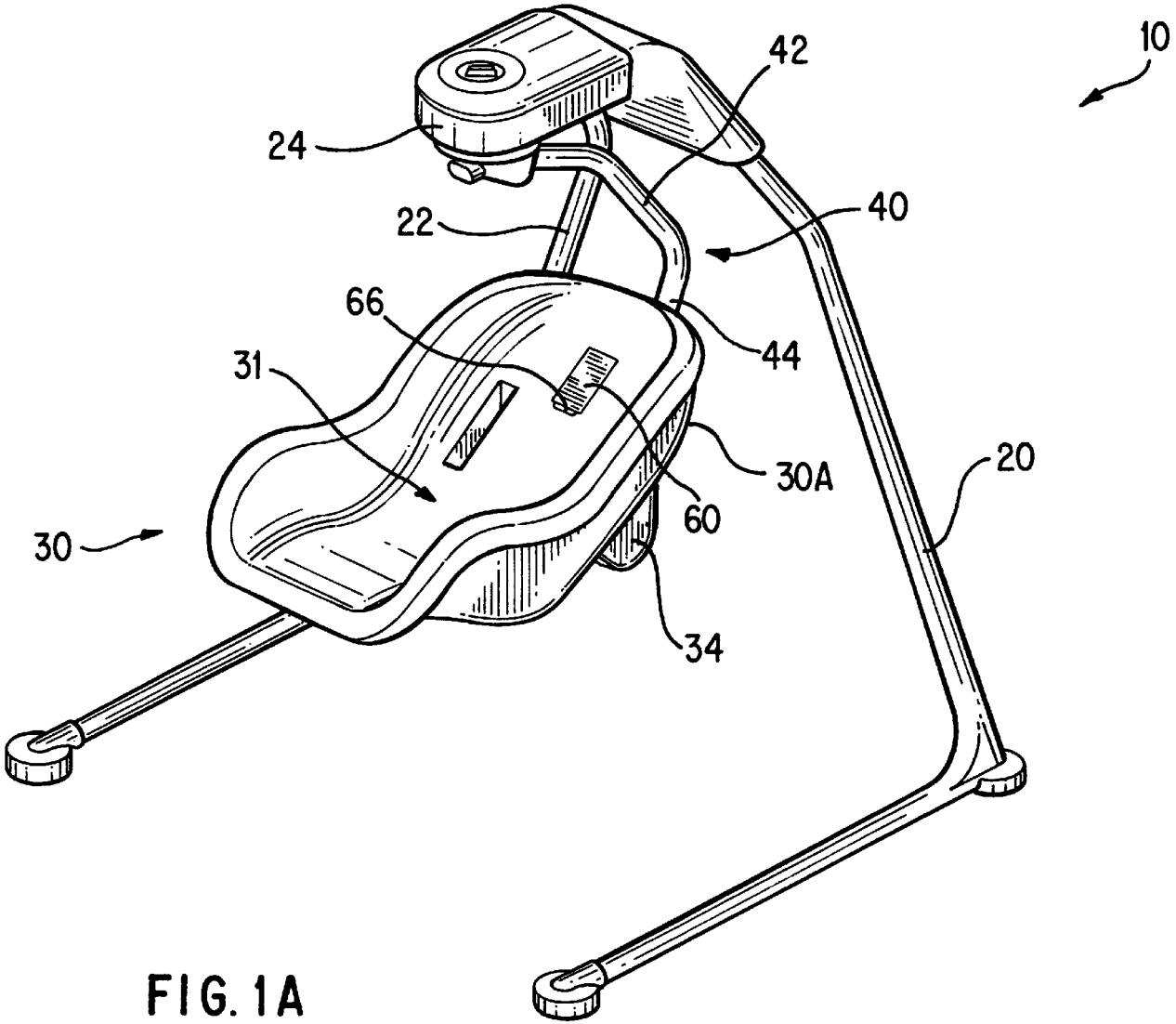
FIGS. 1A and 1B are perspective views of an infant swing embodying the principles of the invention.
Figure 1B:
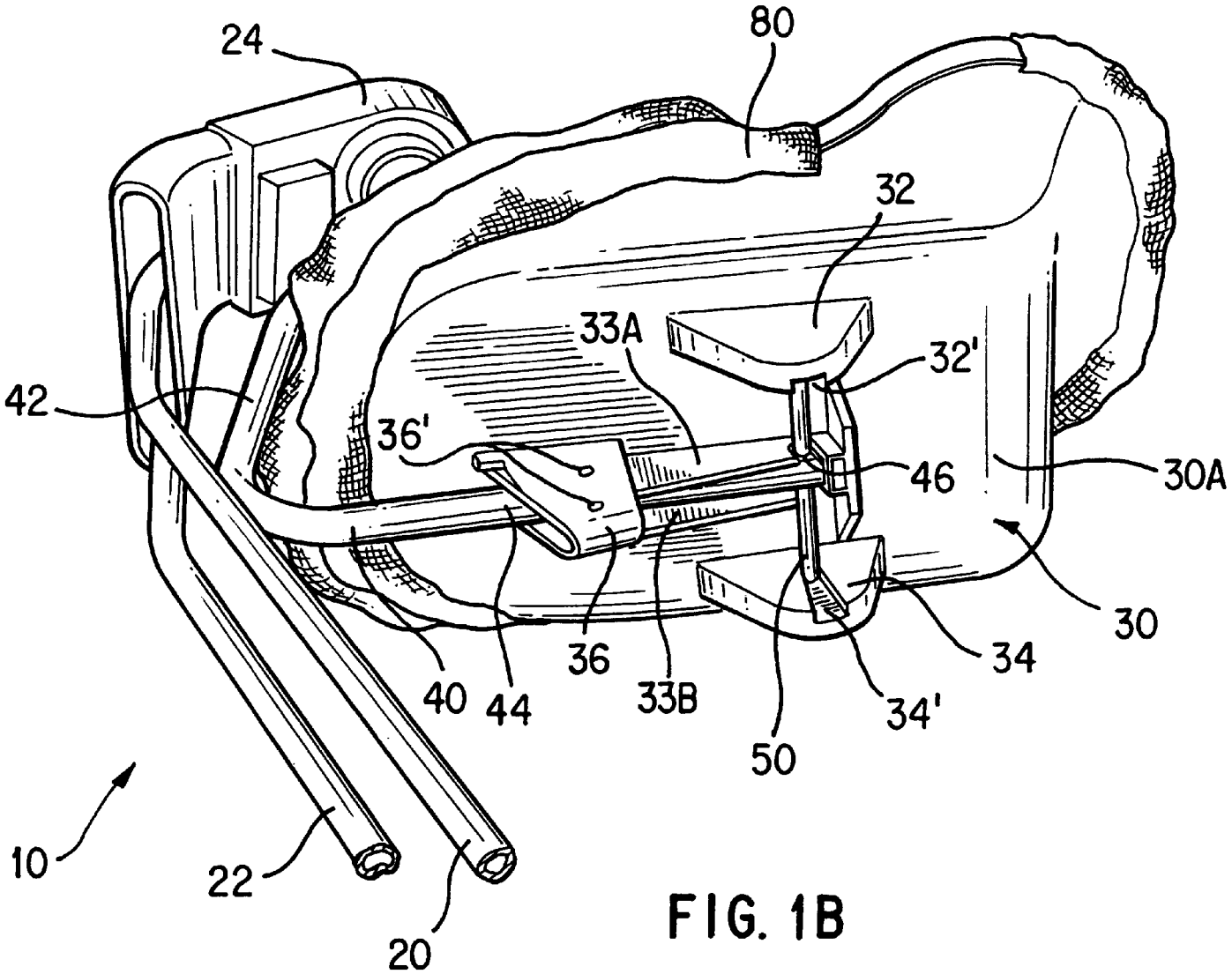
Figure 2:
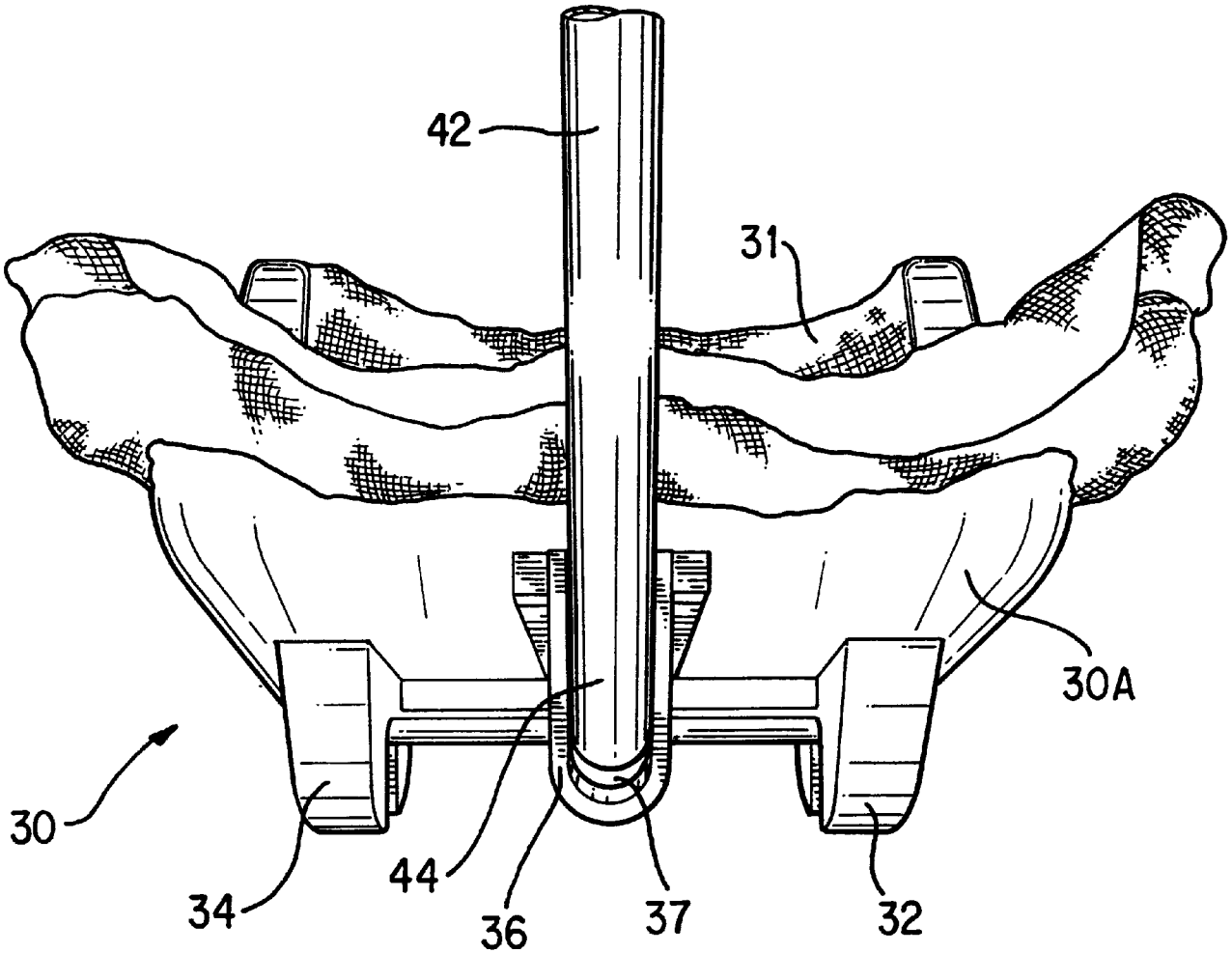
FIG. 2 is a perspective view from the top side of the infant swing shown in FIG. 1A.
Figure 3:
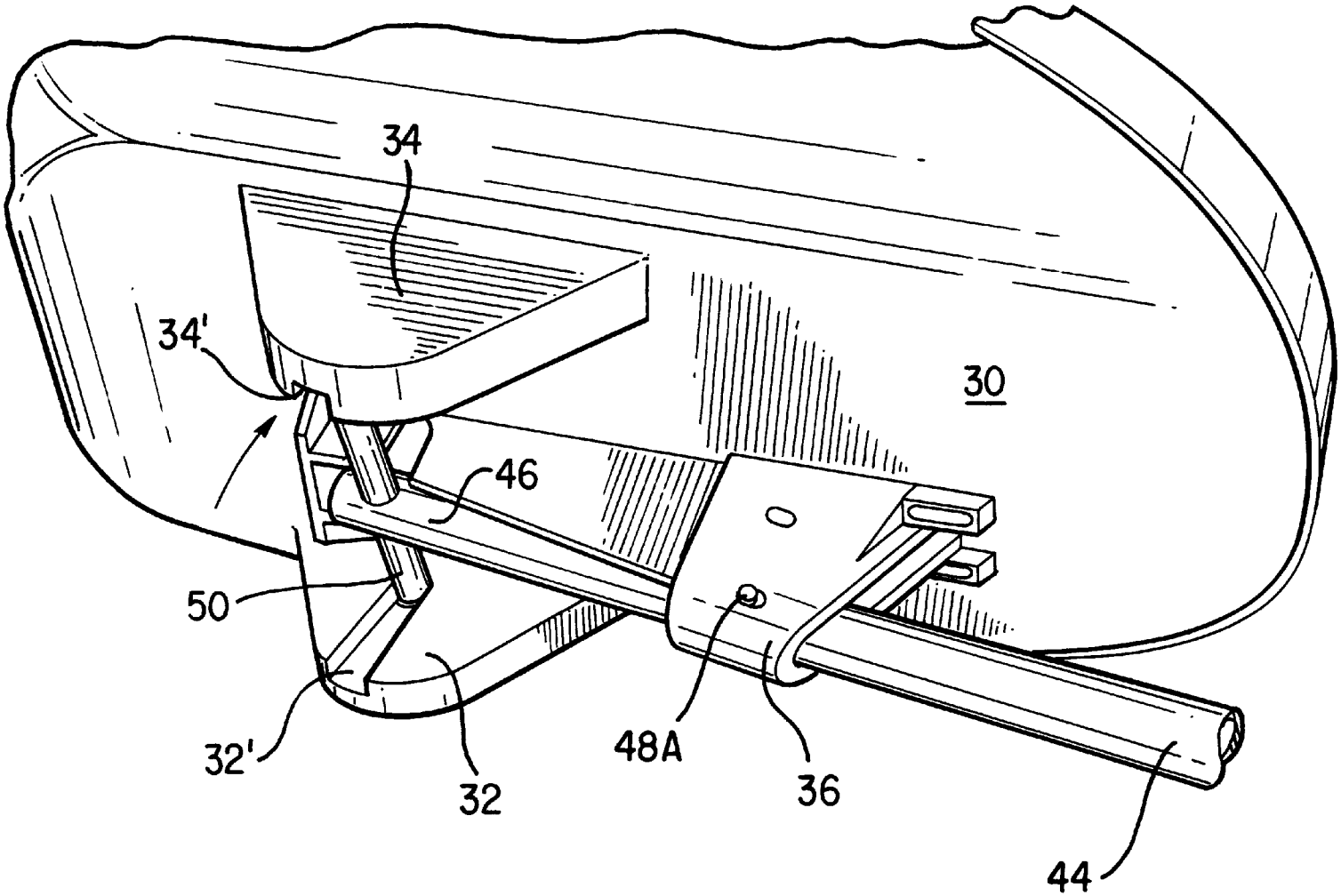
FIG. 3 is a partial perspective view from the back side of the seat showing the interrelationship between the swing arm and the protrusions on the back side of the seat.

An infant swing 10 incorporating the principles of the invention is illustrated in FIG. 1. Swing 10 includes two swing frame legs 20, 22, an upper housing 24 and a child seat 30. As is described in more detail in incorporated U.S. Pat. No. 5,803,817, the upper housing 24 can include a drive assembly with a battery powered motor. The drive assembly can supply motive power to rock the swing about a horizontal swing axis lying in the swing's plane of symmetry (running from front to back).

C-shaped swing arm 40, as best seen in FIG. 1A, extends downwardly from the upper housing 24 and provides support for the infant seat 30. Upper end 42 of swing arm 40 is connected to the upper housing 24, and lower portion 44 of swing arm 40 is pivotally connected to the rear surface 30A of child seat 30, as will be described in more detail below. A connector 148 is disposed between the swing arm 40 and the seat 30 to selectively interengage the swing arm and seat in two relative orientations—a relatively upright position and a relatively inclined position.

In the illustrated embodiment, infant seat 30 includes a seat shell, a U-shaped sleeve projecting from the rear surface of the shell near a first longitudinal end of the shell, two spaced bosses projecting from the rear surface of the shell closer to the second longitudinal end of the shell, and two parallel, longitudinally extending ribs that project at approximately right angles from the rear surface of the shell and that can all be integrally formed during the molding process.

The two spaced bosses 32 and 34 protrude rearwardly from a central portion of the rear surface 30A of child seat 30. Bosses 32 and 34 are preferably positioned to be relatively close to the center of gravity of the child seat when a child is positioned on the seating surface 31. An inverted U-shaped sleeve 36 also extends from the rear surface 30A of child seat 30 at a position closer to the top end of the child seat than the spaced bosses 32 and 34. Parallel ribs 33A and 33B extend at approximately right angles to the rear surface 30A interconnecting an area between bosses 32, 34 and the U-shaped protrusion 36.

Swing arm 40 is provided with a transverse opening 46' at the lower end 46 through which a pivot pin 50 can be inserted for pivotally supporting child seat 30. During assembly of the infant swing 10 the swing arm 40 is first passed through the opening 37 defined by U-shaped sleeve member 36 and through the channel defined between parallel ribs 33A and 33B until the end 46 of swing arm 40 is positioned between bosses 32 and 34. Swing arm lower portion 44 can then be rotated away from back surface 30A until end 46 is positioned above bosses 32 and 34. In this position pivot pin 50 can be inserted through the opening 46' in end 46 of swing arm 40. With pivot pin 50 in position at the end 46 of swing arm 40, the end 46 and pivot pin 50 can now be pressed toward the back surface 30A of seat 30. The ends of pivot pin 50 slide along recessed channels 32' and 34' provided on the facing inner surfaces of bosses 32 and 34 with the bosses 32, 34 deflecting slightly outwardly to accommodate the length of pin 50. The ends of pivot pin 50 then snap permanently into place in slightly deeper recesses (not shown) at the ends of recessed channels 32' and 34'.

Figure 4A:
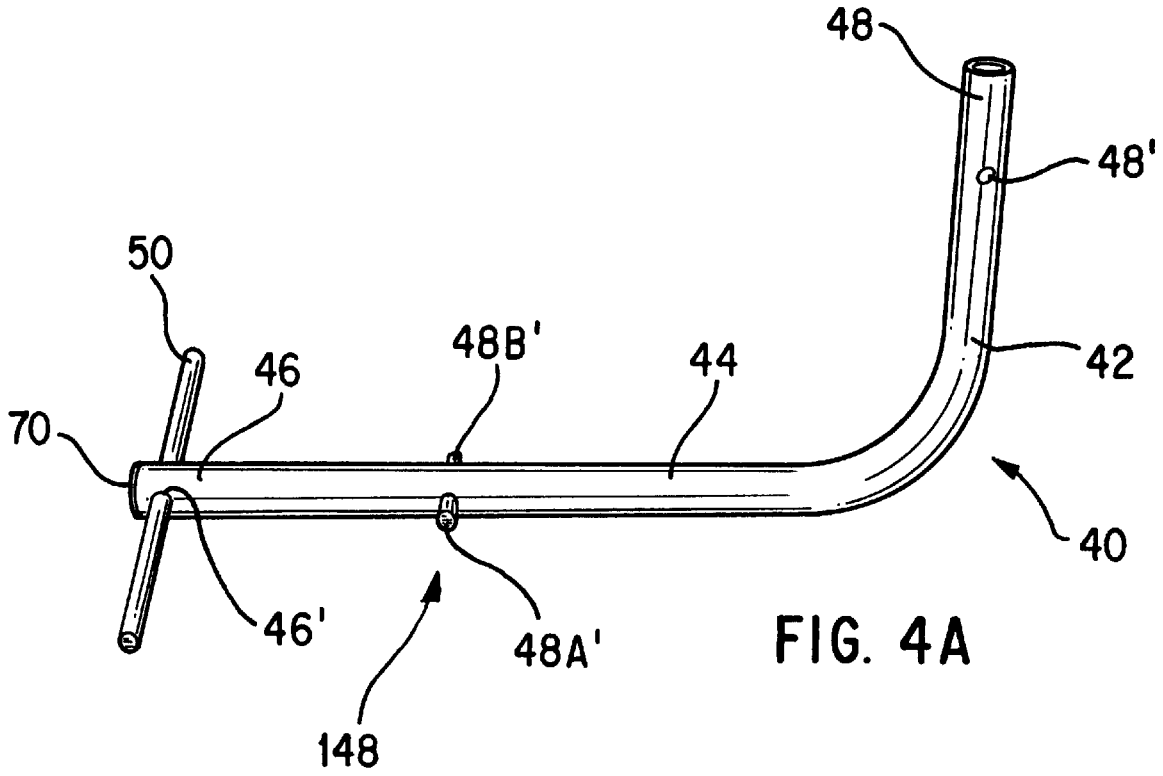
FIG. 4A is a perspective view of the swing arm of the swing shown in FIG. 1A.
Figure 4B:
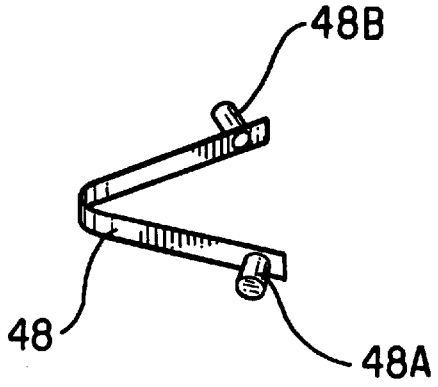
FIG. 4B is a perspective view of the connector before assembly into the swing arm of FIG. 4A.

As best seen in FIG. 4, the lower portion 44 of swing arm 40 is provided with two openings 48A' and 48B' through which spring-biased locking pins 48A and 48B (such as those sold under the trademark "VALCO") can extend. As shown in FIG. 4, the spring-biased locking pins are preferably buttons at the ends of a V-shaped spring member 48. The two buttons 48A and 48B can be pressed together in order to insert the assembly into tube 40, and the assembly can then be slid along the inside of the tube and rotated relative to the tube until the buttons pop out of openings 48A' and 48B'. When assembled, the end 46 of swing arm 40 is pivotally connected to pivot pin 50, and pivot pin 50 is trapped between bosses 32 and 34. The lower portion 44 of swing arm 40 is aligned at least partially within the channel defined between parallel ribs 33A and 33B, and the swing arm 40 is now free to pivot within the opening defined by U-shaped sleeve member 36. Two angularly spaced openings 36' through a side of U-shaped member 36 are provided along the path traveled by spring-biased buttons 48A and 48B as swing arm 40 is pivoted about pivot pin 50. These openings are selectively engaged by the buttons, thus serving as engagement portions of the seat shell.

The child seat 30 can be moved to a more reclined position by depressing the spring-biased buttons 48A and 48B within openings 36' and pivoting the child seat 30 about pivot pin 50 until the spring-biased buttons 48A and 48B protrude from the openings 36' closest to the back surface 30A of the seat 30. Similarly, the seat 30 can be moved to a more upright position by depressing spring-biased buttons 48A and 48B and pivoting the seat about pivot pin 50 until the buttons 48A, 48B protrude from openings 36' spaced further from the back surface 30A of the seat 30.

In a preferred embodiment of the invention the child seat 30 is formed from injection molded plastic with the seat shell 30, bosses 32, 34, ribs 33A, 33B, and U-shaped protrusion 36 all being integrally molded in a conventional injection mold. In order to use conventional injection molding processes during the formation of the child seat with the integral features described above, an opening is provided through the shell 30 into the void defined below the U-shaped sleeve member 36. The opening through the seat 30 remaining after the molding process must be closed off before placing soft goods 80 onto the front side 31 of the seat shell 30 so that the child will not feel the opening through the seat.

Figure 5A:
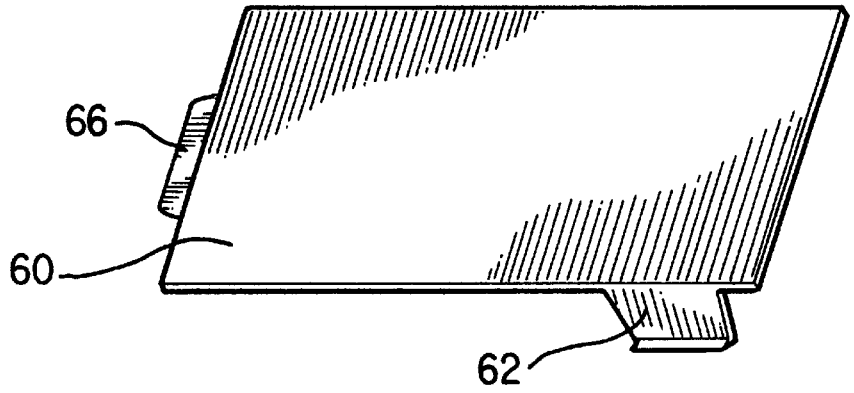
FIGS. 5A, 5B and 5C are a perspective view, a bottom plan view and an end elevation view of a cover for a hole formed through the seat of the swing shown in FIG. 1A.
Figure 5B:
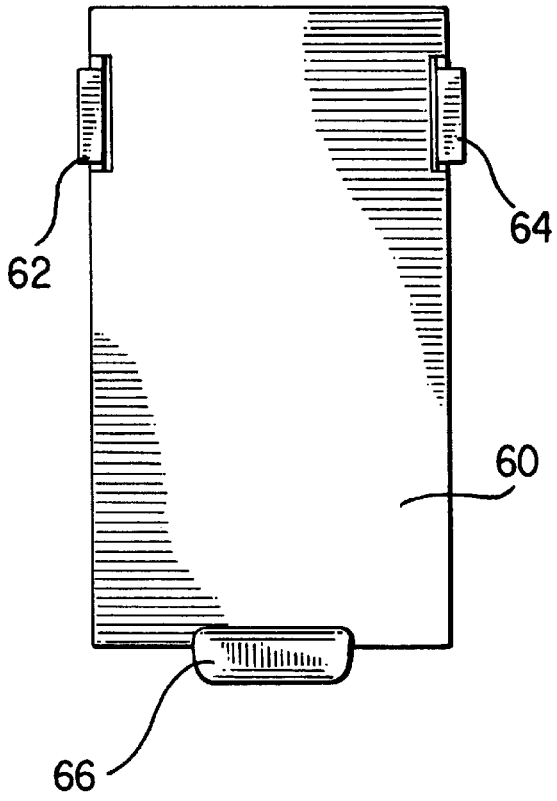
Figure 5C:
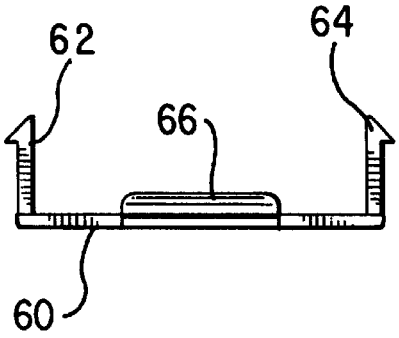

FIGS. 5A–5C provide different views of a hole cover designed to be snapped into place to cover the hole through seat 30. A front lip 66 of the cover 60 fits underneath one edge of the hole while flexible flanges 62 extending from the sides of cover 60 snap into place on sides of the opening through the seat. As a result, the cover 60 is an easily and inexpensively manufactured part that can be quickly and simply snapped into place to cover the opening through seat 30 provided for the molding of U-shaped sleeve member 36 and ribs 33A and 33B.

It will be understood that various modifications and changes can be made in the configuration of the infant swing according to the invention. Although in the preferred embodiment the seat shell is formed by integrally molding the projections from the rear surface of the seat shell, one of ordinary skill in the art will recognize that alternative configurations could provide the projections from the rear surface of the seat as separate pieces that are snapped into place in openings through the seat 30 or that are otherwise connected to the seat 30 using standard fasteners.

It will also be recognized that the number of openings through the U-shaped member projecting from the rear surface of the seat can be varied to provide additional positions at which the seat can be fixed relative to the swing arm. Further, although in the disclosed embodiment the connector that selectively couples the swing arm to the seat shell is implemented as a spring biased button in the swing arm that selectively engages multiple openings in the U-shaped member, in an alternative approach the swing could include multiple connectors mounted to the seat shell and a single opening or detent on the swing arm. Further, the connector can be implemented in any suitable manner that provides selective engagement between the seat shell and swing arm in multiple positions, and need not be a spring biased button engaging with an opening.

What is claimed is:

1. A seat for a child's swing, comprising:

a seat shell having a seating surface and a rear surface opposite the seating surface;

a swing arm having a longitudinal axis and being pivotally connected at a distal end of the swing arm to the rear surface for pivotal movement of the seat shell about a transverse axis substantially perpendicular to the longitudinal axis; and said rear surface including a first projecting portion having two angularly spaced engagement portions engageable with said swing arm for selective positioning of said seat shell relative to said swing arm as said seat shell is pivoted about said transverse axis.

2. The seat according to claim 1, wherein said rear surface further includes additional projecting portions between which a pivot pin aligned with said transverse axis is press fit, with said pivot pin passing through said distal end of said swing arm.

3. The seat according to claim 2, wherein two substantially parallel ribs extend substantially perpendicular to said rear surface and substantially parallel to the longitudinal axis of said seat to define a channel between said first projecting portion and said additional projecting portions.

4. The seat according to claim 3, wherein said swing arm fits within said channel when at least one of said two angularly spaced engagement portions is engaged with said swing arm.

5. The seat according to claim 4, wherein said first projecting portion, said additional projecting portions and said substantially parallel ribs are integrally molded with said seat from plastic material.

6. The seat according to claim 4, wherein said swing arm includes a spring-biased protrusion that engages with one of said angularly spaced engagement portions when said seat is oriented in a more reclined position and engages with the other of said angularly spaced engagement portions when said seat is oriented in a more inclined position.

7. The seat according to claim 1, wherein the pivotal connection between said distal end of said swing arm and said rear surface of said seat shell includes a pin inserted through the distal end of said swing arm, oriented along said transverse axis and press fit between second projecting portions extending from said rear surface.

8. The seat according to claim 7, wherein said first and second projecting portions are integrally molded with said seat.

9. The seat according to claim 8, wherein said first projecting portion forms an opening through which said swing arm is positioned when pivotally connected at said distal end between said second projecting portions.

10. The seat according to claim 9, wherein two parallel ribs extend substantially perpendicular to said rear surface and define a channel extending between said first projecting portion and said second projecting portions, with said swing arm fitting within said channel when at least one of said two angularly spaced engagement portions is engaged with said swing arm.

11. The seat according to claim 10, wherein each of said two angularly spaced engagement portions includes an opening through a side of said first projecting portion, and said swing arm includes a spring-biased protrusion that engages with one of said openings when said seat is oriented in a more reclined position and engages with the other of said openings when said seat is oriented in a more inclined position.

12. A seat for a child, comprising:

a shell being contoured on a front side for support of the child;

a support arm for suspension of said shell, said support arm including means for pivotally mounting said shell for movement between two positions having different angular orientations between said shell and said support arm, and said support arm further including means for selectively maintaining said shell at either of said two positions.

13. The seat according to claim 12, wherein said means for pivotally mounting said shell includes a pivot pin extending substantially perpendicular to said support arm and being engaged with spaced bosses on a rear side of said shell opposite from said front contoured side.

14. The seat according to claim 13, wherein said means for selectively maintaining said shell at either of said two positions includes a spring-biased projection that engages with stops on said rear side of said shell.

15. The seat according to claim 14, wherein said stops are openings through a U-shaped projection on said rear side of said shell, with said U-shaped projection forming a tunnel through which said support arm extends when pivotally mounted to said shell.

16. The seat according to claim 15, wherein said U-shaped projection and said spaced bosses are integrally molded with said shell.

17. A method of reclining an infant seat, wherein the infant seat includes a support arm and a seat shell pivotally supported at a distal end of the support arm with the support arm including a connector moveable between a first, engaged position and a second, released position and engageable with a rear surface of the seat shell at a first engagement portion corresponding to a first, relatively upright position of the seat shell and at a second engagment portion corresponding to a second, relatively reclined position of the seat shell, the method including the steps of:

moving the moveable connector from the first, engaged position to the second, released position to disengage the connector from the first engagement portion with the seat shell in the first, relatively upright position;

pivoting the seat shell about the pivotally supported distal end of the support arm; and aligning the connector with the second engagement portion with the seat shell in the second, relatively reclined position; and moving the connector to the first, engaged position to engage the connector with the second engagement portion to fix the seat shell in the second, relatively reclined position.

18. The method of claim 17 wherein said connector includes a spring-biased protrusion and said first and second engagement portions include openings formed in a sleeve member protruding from the rear surface of the seat shell.

* * * * *